United States Patent [19]

LaSpesa et al.

[11] 4,046,247

[45] Sept. 6, 1977

[54] PRINTER RIBBON CARTRIDGE

[75] Inventors: Richard E. LaSpesa, Chicago; Alfred Z. Purzycki, Arlington Heights, both of Ill.

[73] Assignee: Teletype Corporation, Skokie, Ill.

[21] Appl. No.: 652,363

[22] Filed: Jan. 26, 1976

[51] Int. Cl.[2] ..... B41J 33/10

[52] U.S. Cl. ..... 197/168; 197/151

[58] Field of Search ..... 197/1 R, 151, 168, 171; 242/55.16, 55.19 A, 197; 360/95

[56] References Cited

U.S. PATENT DOCUMENTS

| | | | |
|---|---|---|---|
| 2,755,905 | 7/1956 | Segui | 197/168 |
| 2,917,308 | 12/1959 | Woelfel | 242/55.19 A |
| 3,283,876 | 11/1966 | Kern | 197/168 |
| 3,396,828 | 8/1968 | Moshier et al. | 197/151 |
| 3,726,381 | 4/1973 | Murphy | 197/168 |
| 3,904,018 | 9/1975 | Denley | 197/168 |
| 3,925,820 | 12/1975 | Esashi et al. | 242/55.19 A X |

FOREIGN PATENT DOCUMENTS

| | | | |
|---|---|---|---|
| 2,317,971 | 10/1974 | Germany | 197/151 |
| 2,405,099 | 8/1975 | Germany | 197/151 |

*Primary Examiner*—Edgar S. Burr
*Assistant Examiner*—Paul T. Sewell
*Attorney, Agent, or Firm*—W. G. Dosse; M. Pfeffer

[57] ABSTRACT

A cartridge for an endless band printer ribbon includes a chamber for storing the ribbon in a convolute therewithin. One or more segments of the ribbon are maintained exteriorly of the cartridge to overlie and close the open end of a corresponding depression(s) formed in the cartridge's periphery to form a protrudent member-receiving compartment. The number of depressions corresponds to the number of protrudent ribbon guides (rollers, posts, etc.) in the printer. The protrudent member-receiving compartments are positionable so that their corresponding guides may be simultaneously received therein. After such reception, the cartridge is moved away from the guides, which thereupon engage and withdraw the ribbon from the convolute by unwinding it until the cartridge is mounted to the printer and a portion thereof is properly adjacent a printing location on a platen. The cartridge may also contain a one-way clutch to effect unidirectional ribbon movement and a ribbon re-inker.

10 Claims, 2 Drawing Figures

PRINTER RIBBON CARTRIDGE

BACKGROUND OF THE INVENTION

1. Field of the Invention

This invention relates to a ribbon cartridge and a ribbon handling method, and more particularly to an improved ribbon cartridge for storing an endless ribbon band prior to the use of the ribbon in a utilization device, the cartridge serving as a mount and a guide for the ribbon during its employment in the device. Even more particularly, the present invention relates to a cartridge for a type ribbon usable in a printer and a method of handling the ribbon which result in (a) convenient storage of the ribbon prior to its use in the printer and (b) easy loading of the ribbon into the printer. Additionally, the cartridge may also (c) limit movement of the ribbon to a single direction and (d) re-ink the ribbon during its use in the printer.

2. Description of the Prior Art

Ribbon cartridges, in general, are well-known and include a wide-variety of type-ribbon cartridge usable in printers. Type-ribbon cartridges are used because of the convenience they offer. A well-designed type-ribbon cartridge permits an operator to easily, and quickly load into a printer a new ribbon while preventing the operator's coming in contact with the ribbon to obviate the spreading of ink or other printing media on the hands and clothing of the operator. Most well-known cartridges also serve a guiding and mounting function for the ribbon once it has been loaded into the printer and during its use therein.

One general category of cartridge utilizes an elongated, non-continuous ribbon band. Specifically, the elongated ribbon band is loaded as by coiling into the cartridge, which is then closed. A free end of the ribbon is exposed exteriorly of the cartridge. At the time of mounting the cartridge to the printer, this free ribbon end is engaged by a take-up mechanism within the printer. Often such engagement is accomplished by a ring or other coupling device mounted to the free ribbon end which is engaged by a hook or the like in the take-up mechanism. The cartridge is then moved away from the now engaged end to a point in the printer where the cartridge is mounted. This movement withdraws ribbon from the coil in the cartridge. After mounting of the cartridge in the printer, it serves as a guide for and supply of the ribbon in conjunction with other guides within the printer.

Many such cartridges permit the use of the ribbon contained therein only once. That is, after the ribbon has been pulled once through the printer, it is "used up". The entire cartridge/ribbon combination must then be replaced. In other cartridges of this type the ribbon contains sufficient ink to permit more than one use thereof in the printer. Here, it is usually the case that the take-up mechanism in the printer includes a take-up reel which pulls the ribbon from the cartridge. The cartridge and the take-up reel are either physically reversed or their directions of rotation are reversed so that the cartridge becomes the take-up reel and ribbon is rewound thereon. Reversal of the reel and the cartridge or the rewinding of the ribbon are somewhat inconvenient.

Another type of ribbon cartridge which is becoming widely used is one utilizing an endless band of type ribbon band. Such a band has no free end. Serial portions of the ribbon leave the cartridge, are presented to a printing mechanism in the printer, and then re-enter the cartridge. One well-known type of such a cartridge contains an extremely long ribbon band within the cartridge. The major portion of the ribbon is at all times contained with a "stuffing" unit which maintains the ribbon therein in a compact, dense convoluted or sinuous mass within a storage chamber. Such cartridges are often large and unwieldly, occupying a large space in the printer and generally permit only one passage or a predetermined limited number of passages, of the ribbon through the printer, after which the entire cartridge must be discarded and a new one substituted therefor. Moreover, in this type of cartridge, replacement of the ribbon in order to save money is quite difficult inasmuch as an extremely long portion thereof is normally contained in quite compact form in the convolute within the storage chamber. It is impossible, or nearly so, for the average user to restuff ribbon into the storage chamber.

SUMMARY OF THE INVENTION

A primary object of the present invention is to provide a new and improved ribbon cartridge and a method for its use. The cartridge may be associated with an endless ribbon band, and the ribbon is stored therein prior to its usage in a utilization device such as a printer, and the cartridge may be conveniently associated with the printer to properly present the ribbon for use therein.

Another object of the present invention is to provide an improved ribbon cartridge and a method for its use in which low cost and ease of loading are primary characteristics and which cartridge, if desired, re-inks the ribbon, thus limiting the length of ribbon necessary to be stored within the cartridge.

These and other objects are achieved by the improved cartridge and its method of use according to the present invention. The cartridge may be loaded into a printer to present a length of an endless ribbon band to a multiplicity of printing stations spanning a platen within the printer. Contained within a cartridge housing are means for storing the ribbon, prior to its use in the printer, in a convoluted or sinuous fashion such as in a coil within the housing. The cartridge includes facilities to expose a segment of the ribbon exteriorly of the housing. These facilities permit association with, or engagement of, the exposed ribbon segment by a guide member in the printer and also permit relative movement of the cartridge away from the engaged ribbon segment. This movement withdraws the endless band of ribbon from the cartridge by removal thereof from the convolute, which unwinds the convolute, until a sufficient length of the ribbon is presented for employment by the printer.

Also contained within the cartridge may be facilities for limiting the movement of the ribbon to a single direction. Preferably, that single direction movement is effected by movement of a print head during its return stroke. During the printing stroke of the print head, the ribbon remains stationary, the print head having presented to it as it travels, serial "new" portions of the ribbon. During the return stroke of the print head the ribbon moves with the head so that upon a subsequent print stroke "new" portions of the ribbon are again presented.

The cartridge may also contain facilities for re-inking the ribbon in response to the motion thereof due to movement of the print head. These re-inking facilities permit the use of a short endless ribbon band which need be replaced only after it has been struck or impacted on by the print head sufficient number of times to cause its mechanical properties to degrade.

BRIEF DESCRIPTION OF THE DRAWINGS

With these and other objects in view the present invention may be more easily understood upon the consideration of the following detailed description together with the appended claims and attached drawings in which:

DETAILED DESCRIPTION

I. Environment of Use

Figure 1:
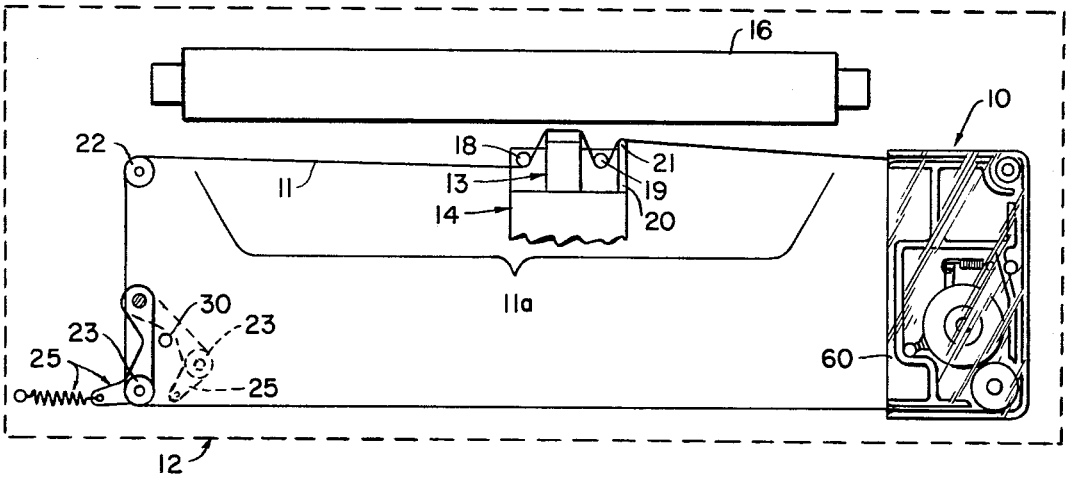
FIG. 1 depicts a generalized view of the top of a portion of a printer and the novel cartridge of the present invention with the cartridge and a ribbon put in place in the printer according to the method hereof.

Referring first to FIG. 1 a ribbon cartridge 10, according to the present invention, holds and guides an endless-band-type ribbon 11 for use in a printer, typewriter, printing terminal or the like 12. The ribbon 11 may be made of nylon, cotton or of any other material suitable for holding or retaining an ink supply.

The specific printer 12 illustrated may be of the type which includes a print head 13 mounted on a movable carriage 14 or the like, which, in turn, is capable of traversing a stationary platen 16. A portion 11*a* of the ribbon band 11 spans the platen 16 along the traversal path of the head 13.

Movement of the head 13 during left-to-right traversal of the platen 16 by the carriage 14 is termed the "print stroke"; right-to-left carriage movement results in a "return stroke" of the head 13. The head 13 contains facilities (not shown) which are selectively impacted against both the ribbon band 11 and a paper sheet (not shown) or other record medium held against the platen 16 to print on the sheet alpha-numeric characters or other indicia, as is well-known.

Typically, in such movable-print-head/stationary-platen printers 12, it is desirable to hold the ribbon band 11 stationary during the print stroke so that serial "new" segments of the ribbon portion 11*a* are presented to the head 13 as it effects printing. Usually, during the return stroke, it is desired to move the ribbon band 11 along with the head 13 so that an entirely "new" portion 11*a* of the ribbon band 11 spans the platen 16 during the next print stroke.

Examples of this type of printer 12 are dot-matrix printers and "bouncing ball" printers. In the former, the impaction facilities in the head 13 may include a plurality of longitudinally driven wires and actuators therefor, as described in commonly-assigned application Ser. No. 512,264 ) filed Oct. 4, 1974) to Bellino et al., now U.S. Pat. No. 3,982,622 and 468,046 (filed May 8, 1974) to DeBoo et al., now U.S. Pat. No. 3,973,661. In the latter, there is a head 13 which utilizes a spherical body which is universally pivotable and tiltable and which contains indicia thereon in the form of raised type fonts.

Unidirectional movement of the ribbon band 11 may be facilitated in either the dot-matrix or the bouncing ball printer types by a pair of rollers or other guides 18 and 19 and a friction member 20 mounted to the carriage 14. As shown in FIG. 1, the ribbon 11 passes over the front of the head 13 and is held in a retroflexed, sinuous path by the rollers 18 and 19. The ribbon 11 also passes over a shoulder 21 of the member 20 which is somewhat forward of the head 13. The relative positions of the head 13, the rollers 18 and 19 and the shoulder 21 may easily be chosen so that movement of the head 13 and the carriage 14 tends to effect the unidirectional movement of the ribbon 11.

Specifically, as viewed in FIG. 1, these relative positions are chosen so that the angle between the shoulder 21 and the ribbon 11 on the right-hand side of the member 20 is quite obtuse while the include shoulder/ribbon angle on the member's left-hand side is quite acute. Accordingly, during the print stroke, the shoulder 21 slides quite easily with little friction over the ribbon 11. During the return stroke, however, the shoulder 21 exerts a large frictional drag on the ribbon 11. Devices elsewhere in the printer 12 may cooperate with the rollers 18 and 19 and the member 20 to insure unidirectional ribbon movement. Such devices may include a "one-way clutch" of the type which locks the ribbon 11 to overcome what little frictional drag is exerted thereagainst during the print stroke, but which permits free ribbon movement during the return stroke.

As discussed below, if the printer 12 includes the rollers 18 and 19 and the member 20 (or functionally similar elements) on the carriage 14, one embodiment of the present cartridge 10 contemplates the inclusion of such a one-way clutch therewithin. Of course, the clutch or its functional equivalent may be included in other desirable locations.

In its broader aspects, the present cartridge is also usable in printers 12 other than the movable -prin-thead/stationary-platen type. For example, the printer 12 may be a standard typewriter in which the platen is stepped to present new printing positions to a printing station into and out of which type fonts are selectively moved. In the typewriter type of printer 12, movement of the ribbon 11 is generally incremental and in a direction opposite to the right-to-left movement of the platen during printing. Moreover the ribbon portion 11*a* is usually shorter than in the previously-discussed printers and may not span the entire platen 16.

Regardless of the type of printer 12, it is assumed herein, that the printer 12 includes (or can be modified to include) facilities for mounting the cartridge 10 thereto during use as well as protrudent members or other guides remote from the mounted cartridge 10 for guiding the ribbon band 11 and facilitating the spanning of the portions 11*a* thereof across the platen 16. The protrudent members are exemplified by a pair of rollers 22 and 23 rotatably mounted to the printer 12. Obviously, one or three, or more rollers may be used. Non-rotatable posts or other functional equivalents may be substituted for the rollers 22 and 23.

One or more of the rollers 23 may be spring-biased as by a pivoted arm/spring combination 25 to keep the ribbon band 11 constantly under tension during use of the printer 12.

EMBODIMENTS OF THE CARTRIDGE 10

Figure 2:
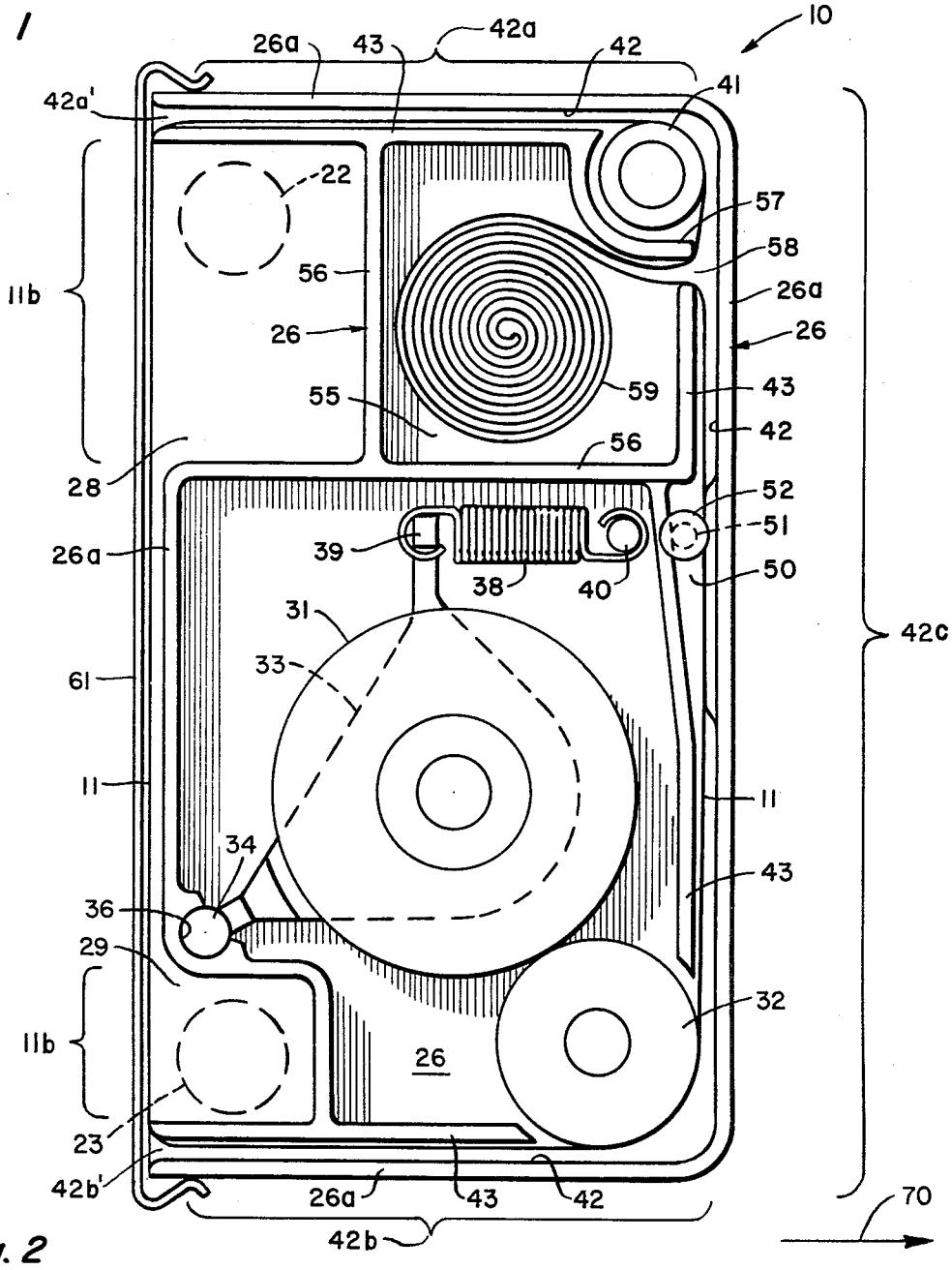
FIG. 2 is a detailed top view of the interior of the cartridge of the present invention depicting specific features thereof according to the present invention.

Referring now to FIG. 2, the cartridge 10 of the present invention is shown in use in a dot-matrix printer 12, although other types of printers are acceptable, as described above. The cartridge 10 includes a housing 26 having a generally rectangular or other convenient outer shape, with two depressions 28 and 29 in the side or peripheral portion intended to face the guide rollers 22 and 23 during use. The depressions 28 and 29 are so spaced apart that they may be placed over and simultaneously receive therein the rollers 22 and 23. the number of depressions 28 and 29 should be equal to the number of guide rollers 22 and 23 (or other type of guides) present in the printer 12. In effecting reception of the rollers 22 and 23 in the depressions 28 and 29, it may be necessary to move the roller 23 to the position shown in phantom in FIG. 1, as by moving the arm/-spring 25 to a position where a pencil or the like inserted into a hole 30 in the printer frame temporarily holds the roller 23 in that position.

Regardless of whether there are two rollers 22 and 23 (or more or less) and whether other structures such as posts are substituted for these rollers 22 and 23, and of the location of these guide structures, the depressions 28 and 29 are so formed and spaced that each may be positioned to receive their respective guide structure at the same time.

If desired, re-inking facilities may be included in the cartridge 10. Specifically, inside and at the lower end of the housing 26, an inking roll 31 and a transfer roll 32 may be rotatably mounted. These rolls 31 and 32 serve a re-inking function, and may be replaced by functional equivalents such as inked pads.

The inking roll 31 has a large diameter and is made of a cellular material such as urethane foam which is capable of holding a supply of printing ink. The inking roll 31 is rotatably mounted on a plate 33, itself pivotable about a pivot pin 34 formed integrally therewith, which pin 34 is pivotally held in a conformal pocket 36 formed as a portion of the housing 26. A tension spring 38, attached both to a lug formed on the plate 33 opposite the pivot pin 34 and to a lug 40 formed as a part of the housing 26, constantly urges the inking roll 31 against the transfer roll 32.

The transfer roll 32 is rotatably mounted to, and may be located near a corner of, the housing 26. As is well-known, the inking roll 31 transfers ink to the transfer roll 32 when both rotate and are urged together.

Also inside the housing 26 and opposite the transfer roll 32 is a rotatably-mounted guide roller 41.

The housing 26 contains a ribbon-receiving channel 42 near and generally following its outer periphery. The channel is in part defined between the inside of the outside walls 26*a* of the housing 26 and integrally formed walls 43 inside of the housing 26. Upper and lower portions 42*a* and 42*b* of the channel are respectively tangent to the guide roller 41 and to transfer roll 32, and each have at the side of the housing 26 a ribbon exit/entrance 42*a'*, 42*b'* by which the ribbon reaches the channel 42. A channel portion 42*c* is tangent to both the guide roller 41 and the transfer roll 32.

It bears repeating that the housing 26 may take any convenient shape or configuration, as may the channel 42. Also, the guide roller 41 may be replaced by a post or other guide medium.

In use, as shown in FIG. 1, the ribbon band 11 passes around the roller 22, into the channel portion 42*a*, around the roller 41, through the channel portion 42*c*, around the transfer roll 32, through and out of the channel portion 42*b*, around the tensioned roller 23, and back to the roller 22. As previously described, each return stroke of the head 13 tends to effect right-to-left movement of the ribbon 11. Such movement continuously presents "new" ribbon surface to the transfer roll 32, so as to re-ink the ribbon 11 with ink picked up from the inking roll 31.

Where it is desirable to include a one-way clutch, as previously discussed, such may be included within the cartridge 10. Specifically, a central, tapered portion 50 of the channel portion 42*c* is widened at the end closer to the roller 41 and narrows down in the direction of the transfer roll 32 to the width of the channel portion 42*c*. The tapered portion 50 contains a knurled pin 51 having an enlarged head 52. The head 52 has a diameter such that it rests on the tops of the walls 26*a* and 43 which define the channel 42 regardless of the position of the pin 51 therein. The pin 51 has a diameter such that in its upper position (i.e., in the widest part of the tapered portion 50) there is a wide clearance between the pin 51 and the walls 26*a* and 43 so that the ribbon band 11 may freely move within the channel 42. In its lower position, the pin 51 locks or wedges the ribbon band 11 against the housing wall 26*a* to prevent ribbon movement. Accordingly, when the pin 51 is moved "up" (by right-to-left ribbon movement FIG. 1) the ribbon 11 is free to move and be re-inked upon the occurrence of the return stroke of the head 13. When, however, the pin 51 is moved "down" (as will be attempted by left-to-right movement of the head 13) the knurled surface of the pin 51 is pulled along a short distance by the ribbon 11 until the ribbon 11 is locked against further movement. The shoulder 21 of the member 20 on the carriage 14 then "slips" over the constrained ribbon 11 during the print stroke of the head 13.

Formed in the housing 26, near the roller 41 is a loading chamber 55 defined by both a plurality of side walls 56 and parts of the side walls 43 as shown. A curved wall 57 isolates the chamber 55 from the roller 41. A slot 58 is formed between the termini of the walls 57 and 43 to provide communication between the channel portion 42*c* above the central tapered portion 50 thereof and the chamber 55. The slot 58 is at least as wide as a double thickness of the ribbon 11.

Prior to use, a part of the continuous ribbon band 11 is placed in the channel 42 and around the rollers 32 and 41. The ribbon exit/entrances 42*a'*, *42b'* are so positioned that segments 11*b* of the ribbon band 11 overlie and close the depressions 28 and 29, as shown in FIG. 2, to expose these segments 11*b* exteriorly of the housing 26 and to form roller-receiving compartments. A major portion of the ribbon band 11 is fed from the channel portions 42*a* and 42*c* through the slot 58 and formed into a convoluted configuration such as a coil 59, a sinuous retroflex, or any other convenient configuration in the chamber 55. By definition, the convolute, of whatever configuration, is unwindable, i.e., can be unwound by removal therefrom of ribbon. Where the coil 59 is selected, it may be formed by rotating a slotted member (not shown) the slot of which is temporarily positioned in the chamber 55 and engages opposite sides of the ribbon 11. After the coil 59 is formed, the slotted member is removed.

The coil 59 is formed so that the rest of the ribbon is more or less tightly maintained in the channel 42 and over the depressions 28 and 29. Again, a coil 59 need not be used; other convolutes and sinuous configurations may be used, as should be apparent.

A cover 60 (shown in place only in FIG. 1) may be placed over the housing 26. The relative heights of the various movable parts in the housing (rolls 31 and 32; guide roller 41; ribbon coil 59; pin 51, ribbon 11) and the walls 26*a*, 43, 56, and 57 are such that the cover 60 maintains the moving parts in their proper orientations and retains them in the cartridge. A snap-on end protector 61 prevents the ribbon segments 11*b* overlying the depressions 28 and 29 and the rest of the ribbon band 11 from being accidentally pulled out of the cartridge 10 prior to use.

In use, the cartridge 10 is positioned so that the ribbon-closed depressions or roller-receiving compartments 28 and 29 overlie and receive the rollers 22 and 23 as shown in phantom in FIG. 2. In effect, the rollers 22 and 23 are received by and held within the compartments formed by the depressions 28 and 29 and the exteriorly exposed ribbon segments 11*b* closing the open ends of the depressions.

The cartridge 10 is now moved to the right in FIG. 1 as shown by the arrow 70 in FIG. 2. Such movement engages both the ribbon segments 11*b* and the end protector 61 with the rollers 22 and 23. Further movement causes the end protector 61 to be pulled off and pulls ribbon 11 out of the housing 26 by unwinding or uncoiling the coil 59 from the chamber 55 through the channel upper channel portion 42*a* and out the exit/entrance 42*a'*. Ultimately, due to continuation of such movement, the cartridge 10 reaches its proper righthand position (FIG. 1) where it is mounted to the printer frame.

Re-inking of the ribbon 11 during operation of the printer 12 then proceeds as described above.

When the ribbon 11 is due for replacement due to its mechanical degradation by the impaction facilities of the head 13, the entire cartridge 10 with its ribbon 11 may be replaced by a new cartridge 10. The operator's fingers need never touch either the old or new ribbons 11. If it is desired to replace the ribbon 11, such may be easily done by removing the cover 60 and approximately threading the new ribbon 11 about the rollers 22, 23, and 41 and the transfer roll 32. Cover removal also facilitates recharging the inking roll 31 with ink, adjusting the tension of the spring 38, lubricating pivots, etc.

Printers 12 having various platen widths may be accommodated by the present cartridge 10 merely by adjusting the amount of ribbon 11 stored in the coil 59 or other convolute within the loading chamber 55. The length of ribbon 11 stored in the coil 59 should be just sufficient so that in use, no ribbon remains in the chamber 55 and the arm/swing 25 may maintain proper tension.

Certain embodiments of the present cartridge 10 have been shown in the drawings and described in this specification. Specifically, the cartridge may or may not include the re-inking facilities or the one-way clutch although these are both present in the preferred embodiment. It should be understood that the invention is not limited to the embodiments shown and is capable of modification. Moreover, this invention may be arranged differently than as depicted without departing from the spirit and scope thereof.

What is claimed is:

1. An improved printer ribbon cartridge of the type in which an endless band of ribbon is stored within a cartridge housing prior to use of the ribbon in a printer, the cartridge being mountable in the printer remotely from a printer-mounted ribbon guide so that a length of the ribbon extending between the mounted cartridge and the guide is presented adjacent to a printing position on a platen in the printer, wherein the improvement comprises:

means for storing the ribbon in a convolute within the housing;

said guide comprising plural protrudent members;

the cartridge having plural open-ended depressions in its periphery;

means for closing the depressions with exposed segments of the ribbon to form plural protrudent compartments corresponding to the number of protrudent members, the depressions being so positioned that the plural compartments may simultaneously receive their corresponding protrudent members, the segments being engageable by the received protrudent members upon movement of the housing away therefrom; and means for permitting both engagement of the exposed segments by the guide and relative movement of the housing away from the guide-engaged segment to withdraw ribbon from the housing by removal thereof from the convolute so that mounting of the cartridge to the printer following such relative movement extends the ribbon length between the housing and the guide to present the ribbon length adjacent the printing position.

2. An improved printer ribbon cartridge of the type in which an endless band of ribbon is stored within a cartridge housing prior to use of the ribbon in a printer, the cartridge being mountable in the printer remotely from a printer-mounted protrudent member, so that a length of the ribbon extending between the mounted cartridge and the protrudent member is presented adjacent to a printing position on a platen in the printer, wherein the improvement comprises:

a. means for storing the ribbon in a convolute within the housing:

b. means i. for exposing a segment of the ribbon exteriorly of the housing and ii. for permitting both engagement of the exposed segment by the protrudent member and relative movement of the housing away from the protrudent-member-engaged segment to withdraw ribbon from the housing by removal thereof from the convolute so that mounting of the cartridge to the printer following such relative movement extends the ribbon length between the housing and the protrudent member to present the ribbon length adjacent the printing position;

c. a channel within the housing for holding a first part of a non-convoluted portion of the ribbon, d. the exposing means including i. an open-ended depression in the periphery of the housing; and ii. means for closing the depression with a second part of the non-convoluted ribbon portion to form a protrudent member-receiving compartment, the second non-convoluted ribbon portion being engageable by the received protrudent member upon movement of the housing away therefrom.

3. An improved cartridge for a printer ribbon of the type in which an endless band of the ribbon is storable prior to use of the ribbon in a printer, the cartridge being mountable in the printer at a location remote from printer-mounted ribbon guide means so that a length of the ribbon spans a platen of the printer between the cartridge and the guide means during both the print strokes and the return strokes of a print head in the printer, wherein the improvement comprises:

A. within the cartridge 1. means responsive to the return strokes of the head for guiding the ribbon along a substantially unconvoluted, U-shaped path interior of the cartridge;

2. means responsive to the ribbon movement for re-inking the ribbon; and 3. means for storing a portion of the ribbon in a convolute prior to the mounting of the cartridge to the printer, the length of ribbon stored in the convolute being sufficient only to span the platen and guide means with no ribbon stored in the convolute after the mounting of the cartridge to the printer; and B. means 1. for maintaining a segment of the non-convoluted ribbon portion exteriorly of the cartridge and 2. for permitting engagement of the segment with the printer-mounted guide means so that, after such engagement, movement of the cartridge toward the remote location and away from the guide means draws all of the ribbon from the convolute and extends the ribbon out of the cartridge to effect the spanning of the platen by a length thereof.

4. The improved printer ribbon cartridge of the type in which an endless ribbon band is storable prior to its use in a printer, the cartridge being mountable in the printer to present a length of the ribbon along the printing positions thereof, wherein the improvement comprises:

with the cartridge 1 means for confining the ribbon to unidirectional movement along a path interior of the cartridge, 2. means responsive to movement for re-inking the ribbon, and 3. a chamber for storing a convoluted length of ribbon isolated from the ribbon path by a plurality of side walls through one of which side walls is a groove communicating with the path and having a width sufficient to permit a double thickness of the ribbon to pass therethrough;

a housing enclosing the cartridge, the housing having an open-ended depression in the periphery thereof, said depression bridgable by a segment of ribbon exteriorly of the cartridge;

means for holding the segment to overlie the open end of the depression so that the segment is engagable by the protrudent guide member received in the depression, relative movement of such member and the cartridge away from each other and along a line passing through the open depression effecting the ribbon withdrawal; and means for permitting both engagement of the segment and relative movement of the cartridge away from the engaged segment to withdraw ribbon from the cartridge by withdrawing the ribbon from the storing means until the length of ribbon is presented along the printing positions in the printer and the convoluted storage of ribbon has been eliminated.

5. An improved printer ribbon cartridge of the type in which an endless ribbon band is storable prior to its use in a printer having a protrudent ribbon guide member, the cartridge being mountable in the printer to present a length of the ribbon along the printing positions thereof, wherein the improvement comprises:

a housing enclosing the cartridge, the housing having an open-ended depression in the periphery thereof;

a channel in a ribbon path within the housing for receiving the ribbon, the channel being defined by opposed side walls, a portion of the channel being enlarged in a direction transverse to the direction of ribbon movement therethrough, the channel tapering inwardly from the enlarged portion in a direction opposite to the movement of the ribbon;

a pin freely movable in the enlarged channel portion, movement of the ribbon within the taper toward the enlarged portion frictionally engaging and moving the pin to a position where there is sufficient clearance between it and the opposed channel side walls to permit free movement of the ribbon, and movement of the ribbon within the taper away from the enlarged portion frictionally engaging and moving the pin to a position where it wedges and locks the ribbon against one of the opposed channel side walls;

means responsive to unidirectional movement for re-inking the ribbon;

a chamber isolated from the ribbon channel by a plurality of side walls through one of which side walls is a groove communicating with the channel and having a width sufficient to permit a double thickness of the ribbon to pass therethrough;

means for holding a segment of the ribbon to overlie the open end of the depressin so that the segment is engageable by the protrudent guide member received in the depression; and means for permitting relative movement of the cartridge away from the engaged segment to withdraw ribbon from the cartridge by withdrawing the ribbon from the chamber until the length of ribbon is presented along the printing positions in the printer.

6. The improved cartridge of claim 5 wherein the confining means further comprises:

a guide roller rotatably mounted within the housing, the channel being tangent thereto, the ribbon passing thereover and rotating the guide roller upon ribbon movement.

7. The improved cartridge of claim 6 wherein the path is bent and a guide roller is located at the bend.

8. The improved cartridge of claim 7 wherein the path is multiply bent and a guide roller is located at each bend and wherein the re-inking means comprises:

a re-inking roller rotatably mounted within the housing and containing a contact-transferrable supply of ink; and means for urging the re-inking roller into contact with one of the guide rollers, so that rotation of the one guide roller rotates the re-inking roller to transfer ink therefrom to the one guide roller and thence to the moving ribbon.

9. The improved cartridge of claim 8 wherein the urging means comprises:

a plate pivotably mounted within the housing;

a shaft on the plate on which shaft the re-inking roller is rotatably mounted; and a resilient tension member connected between the plate and the housing to pivot the plate so that the re-inking roller is in continuous contact with the one roller.

10. A type ribbon cartridge mountable to and usable in a printer, the printer being of a type having both a protrudent guide member for the ribbon and a movable print head which engages and moves the ribbon, the cartridge including:

a housing hving an open-ended depression in the periphery thereof capable of receiving the guide member therein;

a type ribbon in the form of an elongated endless band;

means within the housing for constraining the ribbon therein to unidirectional movement along a fixed path;

means for mounting the cartridge to the printer at a location remote from the guide member;

means for storing within the housing a convoluted portion of the ribbon, a segment of the nonconvoluted portion of the ribbon being drawn over and held across and closing the open end of the depression prior to the mounting of the cartridge in the printer, the length of ribbon in the convolute being sufficient to permit the ribbon to extend between the guide member and the cartridge with no ribbon remaining in convoluted form when the cartridge is mounted to the printer, movement of the housing toward the remote location and away from the guide member after the reception of the guide member in the depression drawing ribbon out of the convolute and the housing; and means for transferring ink to the ribbon as it moves along the fixed path within the housing.

* * * * *